US008618991B2

(12) United States Patent
Jung et al.

(10) Patent No.: US 8,618,991 B2
(45) Date of Patent: Dec. 31, 2013

(54) MOBILE COMMUNICATION TERMINAL

(75) Inventors: Byungwoon Jung, Seoul (KR); Youngbae Kwon, Incheon (KR); Jina Park, Incheon (KR); Ansun Hyun, Seoul (KR); Changwon Yun, Gyeonggi-Do (KR)

(73) Assignee: LG Electronics Inc., Seoul (KR)

( * ) Notice: Subject to any disclaimer, the term of this patent is extended or adjusted under 35 U.S.C. 154(b) by 305 days.

(21) Appl. No.: 13/214,721

(22) Filed: Aug. 22, 2011

(65) Prior Publication Data

US 2012/0105287 A1 May 3, 2012

(30) Foreign Application Priority Data

Nov. 1, 2010 (KR) ..... 10-2010-0107861

(51) Int. Cl.
*H01Q 1/24* (2006.01)

(52) U.S. Cl.
USPC ..... 343/702; 343/700 MS

(58) Field of Classification Search
USPC ..... 343/700 MS, 702
See application file for complete search history.

(56) References Cited

U.S. PATENT DOCUMENTS

| | | | | |
|---|---|---|---|---|
| 7,237,318 | B2 * | 7/2007 | Annamaa et al. | 29/600 |
| 7,501,983 | B2 * | 3/2009 | Mikkola | 343/700 MS |
| 2004/0053635 | A1 * | 3/2004 | Haapala et al. | 455/522 |
| 2008/0316115 | A1 | 12/2008 | Hill et al. | |
| 2009/0160712 | A1 | 6/2009 | Breiter et al. | |
| 2011/0199268 | A1 | 8/2011 | Gapski et al. | |

FOREIGN PATENT DOCUMENTS

| | | | |
|---|---|---|---|
| DE | 10 2007 062 051 | A1 | 6/2009 |
| EP | 1 796 207 | A1 | 6/2007 |

* cited by examiner

*Primary Examiner* — Tan Ho
(74) *Attorney, Agent, or Firm* — Birch, Stewart, Kolasch & Birch, LLP

(57) ABSTRACT

A mobile communication terminal including a wireless communication unit configured to communicate with at least one other terminal; a body including a metal frame having a specified length and a width; a power feeding portion formed on an internal circuit board in the terminal and configured to supply RF signals; and an antenna portion disposed inside the terminal. Further, the antenna portion includes a shorting arm overlapping and being separated from the metal frame, and electrically connected to the metal frame at a first location offset from a middle of an edge of the metal frame; and a feeding arm disposed in parallel to the shorting arm, and electrically connected to the power feeding portion at a second location offset from the middle.

20 Claims, 9 Drawing Sheets

MOBILE COMMUNICATION TERMINAL

Pursuant to 35 U.S.C. §119(a), this application claims the benefit of earlier filing date and right of priority to Korean Application No. 10-2010-0107861, filed on Nov. 1, 2010, the contents of which are incorporated by reference herein in their entirety.

BACKGROUND OF THE INVENTION

1. Field of the Invention

The present disclosure relates to a mobile communication terminal, and more particularly, to a mobile communication terminal having a multi-band antenna.

2. Description of the Related Art

A mobile communication terminal is a portable device that can be hand-carried, as well as having at least one of a voice and video communication function, an information input and output function, a data storage function, and the like.

As it becomes multifunctional, for example, such a mobile communication terminal has complicated functions such as capturing events or moving images, playing music or video files, gaming, receiving broadcast, and the like, so as to be implemented as an integrated multimedia player.

Various new attempts have been applied to such a multimedia player in the aspect of hardware or software to implement a complicated function therein. As an example, a user interface environment is provided for the user to easily or conveniently retrieve or select a function.

A mobile communication terminal also includes radio frequency elements to transmit, receive and process radio signals. Thus, the mobile communication terminal may communicate with wireless base stations using wireless communication, and attempts for providing various wireless communication services in one terminal in an integrated manner have been carried out. For example, the mobile communication terminal may perform communication using cellular phone bands of 850 MHz, 900 MHz, and 1900 MHz (for example, major Global System for Mobile communications or GSM cellular phone bands). Furthermore, for Wideband Code Division Multiple Access (WCDMA) services, it is also used for the mobile communication terminal to provide wireless communication services even at a bandwidth of 1.8-2.17 GHz.

Wide bandwidth components are also used to provide all such multi-band services in one mobile communication terminal. However, an antenna element for transmitting or receiving electromagnetic waves has a resonant characteristic, thereby causing the problem of having a narrow bandwidth characteristic.

SUMMARY OF THE INVENTION

An aspect of the present disclosure is to provide a mobile communication terminal having an antenna device with an enhanced transmission and reception performance of electromagnetic waves.

Another aspect of the present disclosure is to provide a mobile communication terminal having an antenna device capable of implementing an integrated communication services solution.

In order to solve the foregoing problems, a mobile communication terminal according to the present disclosure may include a body provided with a metal frame having a length and a width thereof, a power feeding portion formed on an internal circuit board in the terminal to supply RF signals, and an antenna portion disposed inside the terminal. In addition, the antenna portion may include a shorting arm disposed to be overlapped at a position separated from the metal frame, and electrically connected to the metal frame at a first location offset from the middle of an edge of the metal frame, and a feeding arm disposed in parallel to the shorting arm, and electrically connected to the power feeding portion at a second location offset from the middle.

As an example associated with the present disclosure, the metal frame may be a metal rim formed to surround and support a display unit. A ground provides a reference point of potential of the electrical signals, and may include a first ground formed at a lower end of the body and a second ground formed inside the terminal or on the body.

As an example associated with the present disclosure, the metal frame may be configured to be separated from a first ground formed on the body. The shorting arm and feeding arm may be disposed in a region where the metal frame and the first ground are non-overlapped, and a lower metal portion having a conductivity electrically floated from the first ground may be provided in the non-overlapped region.

As an example associated with the present disclosure, the metal frame may be configured to be electrically connected to the first ground. The mobile communication terminal may include a first ground disposed to be overlapped with part of the metal frame at a position separated from the metal frame, and electrically connected to an edge perpendicular to the other edge of the metal frame at both lateral surfaces thereof, and a second ground corresponding to the metal frame. The shorting arm and feeding arm may be disposed in a region where the first and the second ground are non-overlapped.

As an example associated with the present disclosure, the shorting arm may include a vertical shorting arm formed between the first location and a third location which is a location vertically separated from the first location, a first horizontal shorting arm extended from the third location to one side in a linear form, and a second horizontal shorting arm extended from the third location to the other side in a linear form. The feeding arm may include a vertical shorting arm formed between the second location and a fourth location which is a location vertically separated from the second location, a first horizontal shorting arm extended from the fourth location to one side in a linear form, and a second horizontal shorting arm extended from the fourth location to the other side in a linear form. The shorting arm may further include an intersecting shorting arm bent and extended at both ends of the first and the second horizontal shorting arm. The feeding arm may further include an intersecting shorting arm bent and extended at both ends of the first and the second horizontal feeding arm.

As an example associated with the present disclosure, the mobile communication terminal may further include a coupling arm disposed to be spaced apart in parallel to the feeding arm, and coupled with an electrical signal of the feeding arm.

As an example associated with the present disclosure, the shorting arm may be electrically connected to the metal frame through a first connector, and the feeding arm may be electrically connected to the power feeding portion through a second connector. The first connector may include a first connecting member allowing the shorting arm to be connected to a ground formed on the circuit board, and a second connecting member allowing the ground formed on the circuit board to be connected to a ground formed on the terminal body.

As an example associated with the present disclosure, the shorting arm and feeding arm may be formed with a structure having a meander-shaped pattern to increase an electrical length thereof.

As an example associated with the present disclosure, the shorting aunt and feeding arm may be configured to be printed on an upper surface of a dielectric substrate and supported by a dielectric substance of the dielectric substrate.

As an example associated with the present disclosure, the shorting arm and feeding arm may be separated from each other in a vertical direction and layered thereon. Here, the shorting arm and feeding arm may be configured to be printed on an upper surface of a plurality of dielectric substrates, respectively, the dielectric circuit substrate being layered thereon in a vertical direction, and separated from each other by a dielectric substance of the dielectric substrate to be supported.

As an example associated with the present disclosure, the shorting arm and feeding arm may be disposed to be separated from each other on the same plane. Here, the shorting arm and feeding arm may be printed on an upper surface of the same dielectric circuit substrate such that the shorting arm and feeding arm are supported by the dielectric substance.

As an example associated with the present disclosure, the shorting arm may be formed on an outer center of a coaxial cable, and the feeding arm may be formed on an inner center of the coaxial cable such that the outer and the inner center are electrically connected to the metal frame and power feeding portion, respectively.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Figure 1:
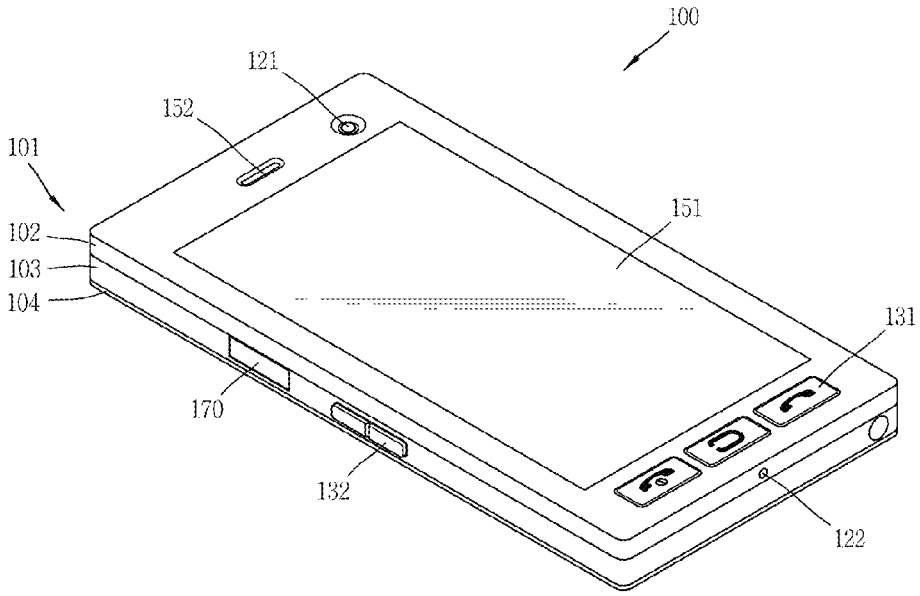
FIG. 1 is a perspective view illustrating a mobile communication terminal according to an embodiment of the present invention.

Hereinafter, a mobile terminal associated with the present invention will be described in more detail with reference to the accompanying drawings. The suffixes "module" and "unit or portion" for components used in the following description merely provided only for facilitation of preparing this specification, and thus they are not granted a specific meaning or function.

This specification employs like/similar reference numerals for like/similar components irrespective of different embodiments, so they all will be understood by the first description. The expression in the singular form in this specification will cover the expression in the plural form unless otherwise indicated obviously from the context.

FIG. 1 is a perspective view illustrating a mobile communication terminal 100 associated with the present invention.

The mobile communication terminal 100 disclosed herein includes a bar-type terminal body 101. However, the present invention is not only limited to this, but also applicable to various structures of terminals such as a bar type comprised of one body, or a slide type, a folder type, a swivel type, a swing type, and the like, in which two and more bodies are combined with each other in a relatively movable manner.

The body 101 includes a case (casing, housing, cover, etc.) forming an appearance of the terminal. In this embodiment, the case may be divided into a metal frame 102 corresponding to a front case and a rear case 104. Various electronic components may be incorporated in a space formed between the metal frame 102 and the rear case 104. At least one intermediate case may be additionally disposed between the front case 102 and the rear case 104.

The cases may be formed by injection-molding a synthetic resin or may be also formed of a metallic material such as stainless steel (STS), titanium (Ti), or the like.

All or part of the body 101, or a bezel portion or the cases of the terminal may be configured with a metallic material having a conductivity to be used as a ground corresponding to a reference potential of the electromagnetic signals.

A display unit 151, an audio output unit 152, a camera 121, a first user input unit 131, a microphone 122, an interface 170, and the like may be arranged on the metal frame 102 of the body 101. The mobile terminal also includes a second user input unit 132 and an intermediate case 103.

The display unit 151 occupies most of the front surface of the metal frame 102. The audio output unit 152 and the camera 121 may be disposed on a region adjacent to one of both ends of the display unit 151, and the first user input unit 131 and the microphone 122 may be disposed on a region adjacent to the other one thereof. The second user input unit 132, the interface 170, and the like may be disposed on lateral surfaces of the metal frame 102 and the rear case 104. A window for protecting the display unit 151 may be provided on an upper surface of the display unit 151.

The user input unit is configured to receive a command for controlling the operation of the mobile communication terminal 100, and FIG. 1 illustrates the first user input unit 131 disposed at a front surface of the body 101 and the second user input unit 132 disposed at a lateral surface thereof. The first and the second manipulation unit 131, 132 may be commonly designated as a manipulating portion, and any method may be employed if it is a tactile manner allowing the user to perform manipulation with a tactile feeling.

The content input by the first and the second manipulation unit 131, 132 may be configured in various ways. For example, the first manipulation unit 131 may receive a command, such as start, end, scroll, or the like, and the second manipulation unit 132 may receive a command such as volume control of sound output from the audio output unit 152, switching into a touch recognition mode of the display unit 151, or the like.

Figure 2:
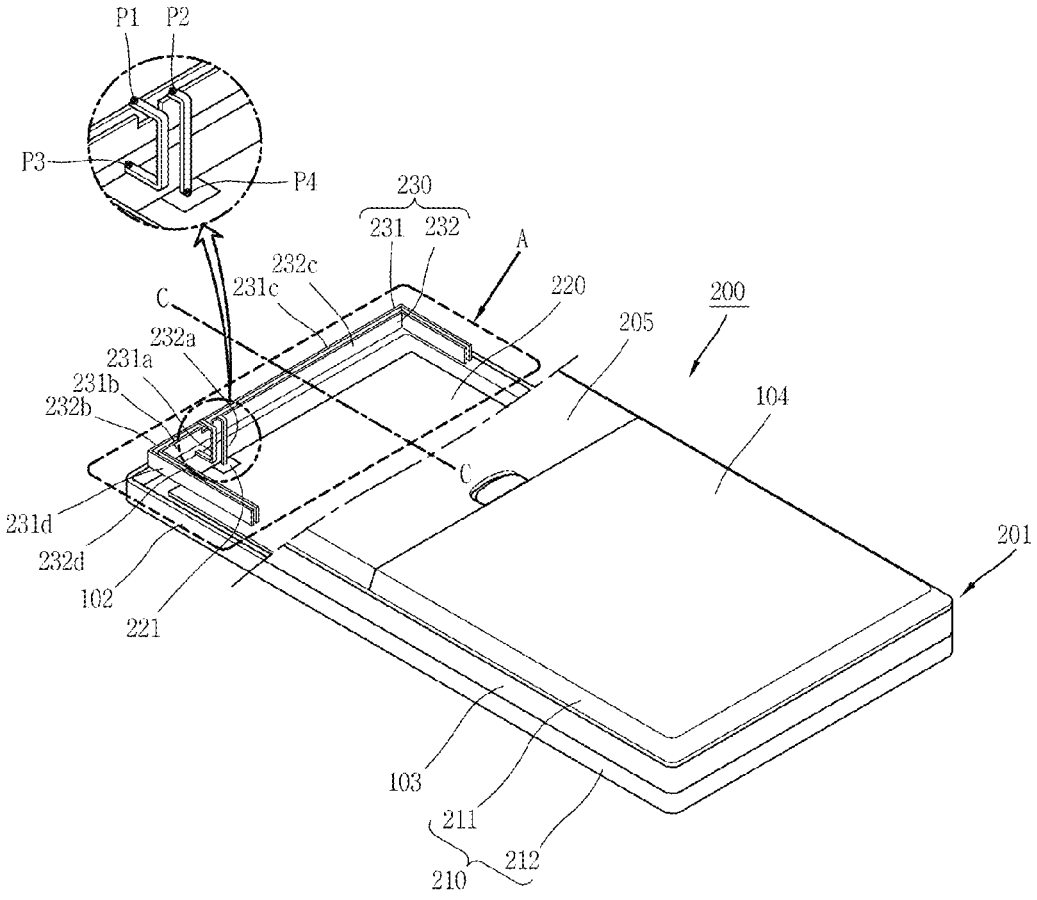
FIG. 2 is a cross-sectional perspective view illustrating part of a mobile communication terminal mounted with an antenna portion according to an embodiment of the present invention.

FIG. 2 is a cross-sectional perspective view illustrating part of a mobile communication terminal mounted with an antenna portion according to an embodiment of the present invention.

As shown, the mobile communication terminal 200 includes a body 201, a ground 210, a circuit board 220, and an antenna portion 230. The body 201 corresponds to a case of the mobile communication terminal 200, and includes the metal frame 102, the intermediate case 103, the rear case 104, and a lower non-metallic portion 205.

The metal frame 102 is a metal rim formed to surround and support the display unit 151. Furthermore, the metal frame 102 may form a loop having four edges, and the display unit 151 may be mounted at an inner portion of the loop to be supported. In addition, the ground 210 provides a reference point of potential of the electrical signals, and includes a first ground 211 formed at a lower end of the body 201 and a second ground 212 formed inside the terminal or on the body 201.

The metal frame 102 is also configured to be separated from the first ground 211. Here, the metal frame 102 and the first ground 211 may be physically connected to the intermediate case 103 by a dielectric substance, which is an electrically insulated material. For the intermediate case 103, a plastic material or the like may be used as the dielectric substance, and may be formed by injection-molding a synthetic resin.

As illustrated in the drawing, the lower non-metallic portion 205 is disposed in a region (A) where the metal frame 102 and the first ground 211 do not overlap The lower non-metallic portion 205 may be fabricated by using a dielectric substance having no conductivity such as plastic or the like, thereby having no effect on the radiation electromagnetic waves.

Further, the circuit board 220 may be disposed inside the terminal 100, and includes a power feeding portion 221 formed on the circuit board 220 within the terminal 100 to supply radio frequency (RF) signals. Also, the antenna portion 230 is disposed inside the terminal to receive RF signals from the power feeding portion 221 and radiate electromagnetic waves.

As shown, the antenna portion 230 includes a shorting arm 231 and a feeding arm 232. The shorting arm 231 and feeding arm 232 is disposed in a region (A) where the metal frame 102 and the first ground 211 are not overlapped. Also, the shorting arm 231 is disposed to be overlapped at a position separated from the metal frame 102, and electrically connected to the metal frame 102 at a first location (P1) offset from the middle (C) of an edge of the metal frame 102.

The shorting arm 231 also includes a vertical shorting arm 231*a* formed between the first location and a third location (P3) which is a location vertically separated from the first location, a first horizontal shorting arm 231*b* extended from the third location (P3) to one side in a linear form, and a second horizontal shorting arm 231*c* extended from the third location (P3) to the other side in a linear form.

The shorting arm 231 further includes an intersecting shorting arm 231*d* bent and extended at both ends of the first and the second horizontal shorting arm 231*b*, 231*c*. The electrical length of the shorting arm 231 may be increased by the intersecting shorting arm 231*d*, thereby obtaining desired antenna characteristics.

The feeding arm 232 is also disposed in parallel to the shorting arm 231, and electrically connected to the power feeding portion 221 at a second location (P2) offset from the middle. The feeding arm 232 includes a vertical shorting arm 232*a* formed between the location and a fourth location (P4) which is a location vertically separated from the second location, a first horizontal shorting arm 232*b* extended from the fourth location (P4) to one side in a linear form, and a second horizontal shorting arm 232*c* extended from the fourth location (P4) to the other side in a linear form.

The feeding arm 232 also includes an intersecting shorting arm 232*d* bent and extended at both ends of the first and the second horizontal feeding arm 232*b*, 232*c*. The electrical length of the feeding arm 232 may be increased by the intersecting shorting arm 231*d*, thereby obtaining desired antenna characteristics. In addition, each arm of the antenna portion 230 may be fabricated in a metal sheet type having a low thickness with conductivity, having a length corresponding to an electrical resonance length and a narrow width that can be inserted inside the terminal.

Further, the shorting arm 231 and feeding arm 232 may be disposed on different planes. One method of disposing the arms inside the terminal will be described as follows. For example, the shorting arm 231 and feeding arm 232 may be printed on an upper surface of the dielectric substrate to be supported by a dielectric substance of the dielectric substrate. The dielectric substrate may also be disposed in perpendicular to a plane including the metal frame 102. Accordingly, the shorting arm 231 and feeding arm 232 are printed on different dielectric substrates, respectively, and thus they are not brought into contact with each other but separated by the dielectric substance having a predetermined thickness.

Furthermore, the antenna portion 230 may be fabricated in a patterning form on a flexible PCB. Here, a horizontal arm and an intersecting arm that intersects the horizontal arm may be fabricated in an integrated form, and the flexible PCB formed with the each arm may be bent to fabricate the antenna portion 230.

Furthermore, the antenna portion 230 may be fabricated by molding or welding a metal plate (radiator) to a dielectric carrier. Also, the shorting arm 231 and feeding arm 232 may be implemented by using a coaxial cable. The shorting arm 231 of the antenna portion 230 may also be formed on an outer center of the coaxial cable, and the feeding arm 232 may be formed on an inner center of the coaxial cable such that the outer and the inner center are electrically connected to the metal frame 102 and power feeding portion 221, respectively.

Figure 3:
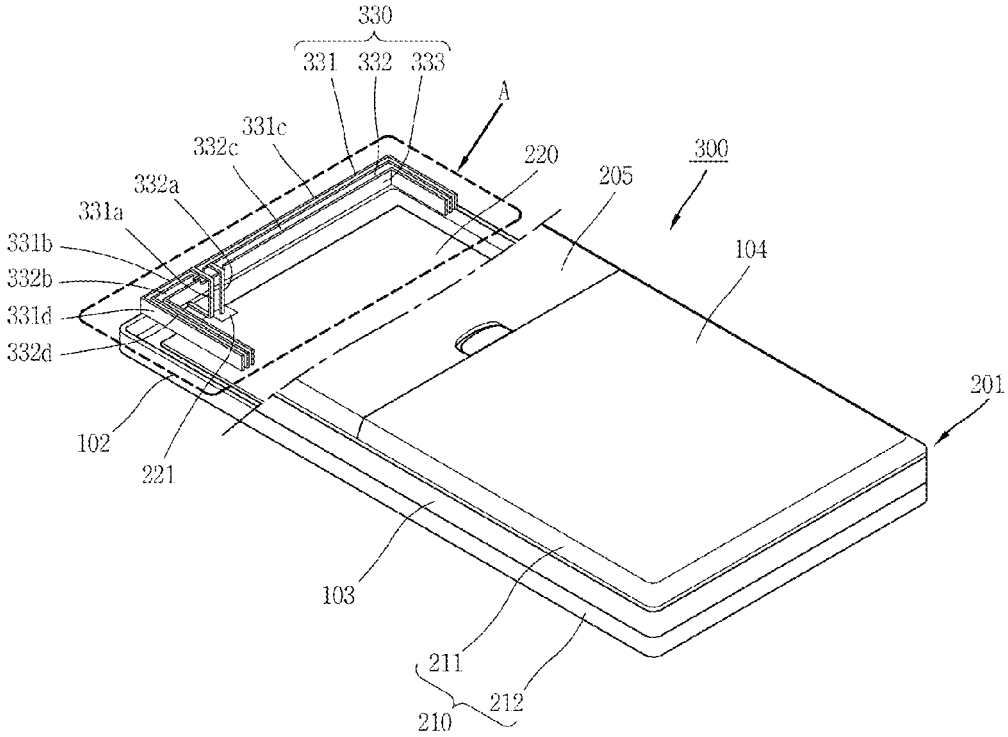
FIG. 3 is a cross-sectional perspective view illustrating part of a mobile communication terminal mounted with an antenna portion according to another embodiment of the present invention.

Next, FIG. 3 is a cross-sectional perspective view illustrating part of a mobile communication terminal 300 mounted with an antenna portion according to another embodiment of the present invention. As shown, the mobile communication terminal 300 includes the body 201, the ground 210, the circuit board 220, and an antenna portion 330. The body 201, the ground 210 and the circuit board 220 are similar to the mobile communication terminal 200 in FIG. 2, and thus the detailed description thereof is omitted. The antenna portion 330 will be described as follows.

In more detail, the antenna portion 330 includes a coupling arm 333 in addition to the shorting arm 331 and the feeding arm 332. The coupling arm 333 is disposed to be spaced apart in parallel to the feeding arm 332, and thus an electrical signal of the feeding arm 332 is coupled to the coupling arm 333. Accordingly, the coupling arm 333 is included in the antenna portion 330 to increase an electrical length thereof, and as a result, the coupling arm 333 generates another resonant mode at a lower bandwidth than that of the shorting arm 331 and feeding arm 332, thereby enhancing the bandwidth characteristics.

Figure 4:
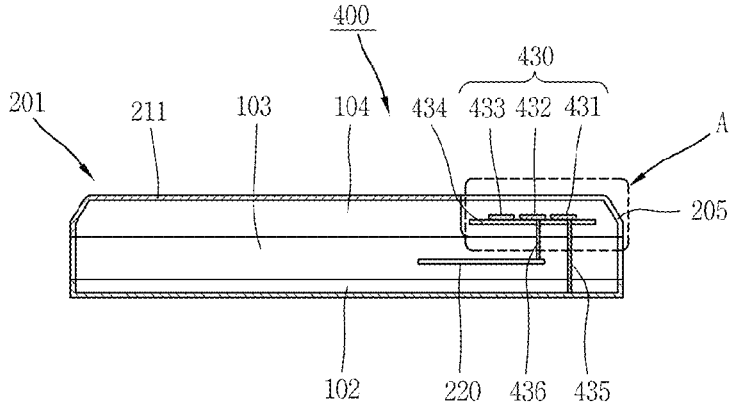
FIG. 4 is a conceptual view illustrating a mobile communication terminal mounted with an antenna portion according to still another embodiment of the present invention.

Next, FIG. 4 is a conceptual view illustrating a mobile communication terminal 400 mounted with an antenna portion according to still another embodiment of the present invention. As shown, the mobile communication terminal 400 includes the body 201, the ground 210, the circuit board 220, and an antenna portion 430. The body 201, the ground 210 and the circuit board 220 are similar to the mobile communication terminal 300 in FIG. 3, and thus the detailed description thereof is omitted. The antenna portion 430 will be described as follows.

In the body 201, the metal frame 102 and the rear case 104 may be formed of a metallic material, and the intermediate case 103 and the lower non-metallic portion 205 may be formed of a non-metallic material, which is a dielectric substance such as plastic or the like. Further, the antenna portion 430 includes a shorting arm 431, a feeding arm 432, and a coupling arm 433, and the arms are disposed to be separated from one other on the same plane. In addition, the shorting arm 431 and feeding arm 432 may be printed on the same dielectric substrate 434 to be supported by the dielectric substance. Accordingly, the dielectric substrate 434 is disposed in parallel to the circuit board 220 disposed with the power feeding portion 221.

The shorting arm 431 and feeding arm 432 may also be formed with a structure having a meander line-shaped pattern to increase an electrical length thereof Furthermore, a capacitance component between the aims is increased by the meander line, and thus the antenna portion 430 will have a wide bandwidth characteristic because an inductance component and the capacitance component generated when the arms are disposed to be adjacent to one other cancel each other.

Also, the arms of the antenna portion 430 may not be disposed on a same plane but be separated from each other in a vertical direction to be layered thereon. Further, the arms can be printed on an upper surface of a plurality of dielectric substrates, respectively, the dielectric circuit substrate being layered thereon, and separated from each other by a dielectric substance of the dielectric substrate to be supported.

The shorting arm 431 is also electrically connected to the metal frame 102 through a first connector 435, and the feeding arm 432 is electrically connected to the power feeding portion 222 through a second connector 436. The first and the second connectors 435 and 436 may be formed in a metal plate form to be fabricated into an integrated form as illustrated in the shorting arm 431 and feeding arm 432. The connectors 435 and 436 may also be implemented in the form of directly brought into contact with the metal frame 102 or power feeding portion 221 to provide a larger supporting force than the connection with the metal frame 102 or power feeding portion 221, and in this instance, an elastic pin (or finger) may be used.

The first and the second connectors 435 and 436 illustrated in FIG. 4 correspond to the vertical shorting arm 231*a* and the vertical feeding aim 232*a*, respectively, shown in FIG. 2. Also, the first connector 435 includes a first connecting member allowing the shorting arm 431 to be connected to a ground formed on the circuit board 220, and a second connecting member allowing the ground formed on the circuit board 220 to be connected to a ground formed on the body 201. The length of the first connector 435 is a vertical distance from the metal frame 102 to the shorting arm 431, and the vertical distance corresponds to 8-9 mm when considering the height of the terminal. Accordingly, the connection by the first and the second connecting members is more effective in reducing a space occupied by the connecting member inside the terminal than that of the first connector 435 by one connecting member. Even though the first connector 435 is implemented by the first and the second connecting member, there is no difference in the loss or leakage amount of electromagnetic waves in a mutual connection position as compared with being implemented by one connecting member.

Figure 5:
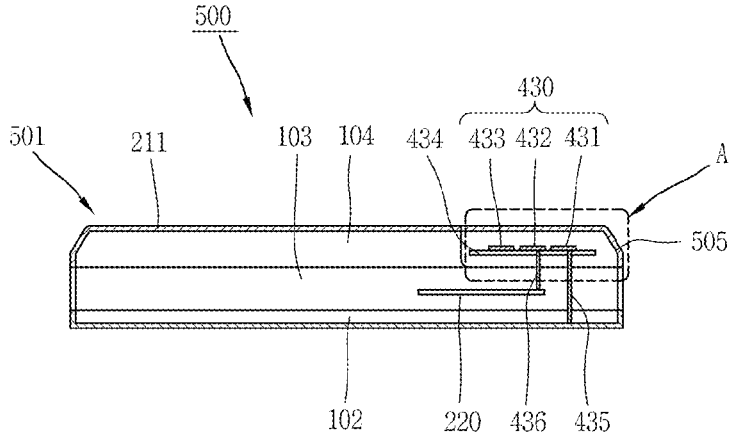
FIG. 5 is a conceptual view illustrating a modified example of a mobile communication terminal mounted with an antenna portion in FIG. 4.

Next, FIG. 5 is a conceptual view illustrating a modified example of a mobile communication terminal 500 mounted with an antenna portion 430 in FIG. 4. The mobile communication terminal 500 includes a body 501, the ground 210, the circuit board 220, and the antenna portion 430. The ground 210, the circuit board 220 and antenna portion 430 are similar to the mobile communication terminal 400 in FIG. 4, and thus the detailed description thereof is omitted.

The body 501 corresponds to the mobile communication terminal 500, and includes the metal frame 102, the intermediate case 103, the rear case 104, and a lower metallic portion 505. In the body 501, the metal frame 102, the rear case 104, and the lower metallic portion 505 are formed of a metallic material, and the intermediate case 103 is formed of a non-metallic material, which is a dielectric substance such as plastic or the like.

As illustrated in the drawing, the lower metallic portion 505 is provided in a non-overlapped region (A), and the lower metallic portion 505 is formed of a material having an electrically floating conductivity. In order to allow the lower metallic portion 505 to be electrically floated from the first ground 211, a dielectric substance such as plastic or the like can be inserted into a space between the lower metallic portion 505 and the rear case 104.

Here, the first ground 211 is electrically separated from the metal frame 102, and thus it does not give a great influence on the electrical characteristic variation of the antenna portion 430. Accordingly, the lower metallic portion 505 is fabricated with a metallic material having a conductivity to be formed together with the first ground 211 in an integrated form. However, even though there is more or less an effect by the first ground 211, the length and arrangement interval of each arm, and the position of a power feeding point can be controlled to obtain the desired electrical characteristics of the storage unit 430.

Figure 6:
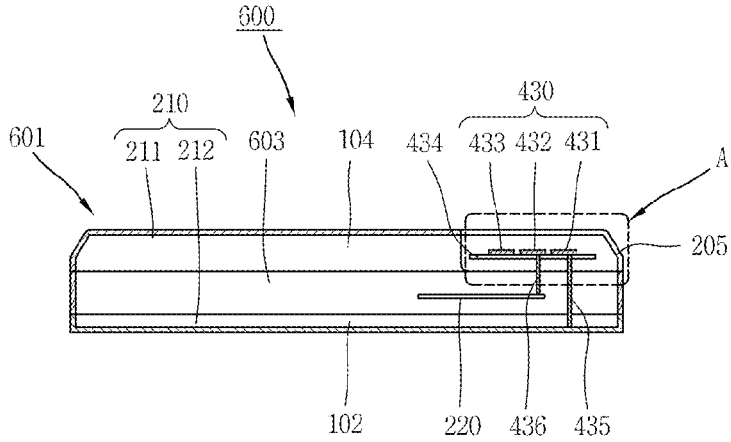
FIG. 6 is a conceptual view illustrating another modified example of a mobile communication terminal mounted with an antenna portion in FIG. 4.

FIG. 6 is a conceptual view illustrating another modified example of a mobile communication terminal 600 mounted with an antenna portion in FIG. 4. The mobile communication terminal 600 includes a body 601, the ground 210, the circuit board 220, and the antenna portion 430. The ground 210, the circuit board 220 and the antenna portion 430 are similar to the mobile communication terminal 400 and 500 in FIGS. 4 and 5, and thus the detailed description thereof is omitted.

The body 6501 corresponds to the mobile communication terminal 600, and includes the metal frame 102, the rear case 104, the lower non-metallic portion 205, and an intermediate case 603. In the body 601, the metal frame 102, the intermediate case 603, and the rear case 104 are formed of a metallic material, and the lower non-metallic portion 205 is formed of a non-metallic material, which is a dielectric substance such as plastic or the like. The metal frame 102 can also be configured to be electrically connected to the first ground 211 through the intermediate case 603.

Here, the first ground 211 is disposed to be overlapped with part of the metal frame 102 at a position separated from the metal frame 102, and electrically connected to an edge perpendicular to the other edge of the metal frame 102 at both lateral surfaces thereof. The second ground 222 corresponds to the metal frame 102. In other words, when the metal frame 102 is connected to the first ground 211, the intermediate case 603 can be configured with a metallic material having a conductivity, and fabricated in an integrated manner together with the metal frame 102 corresponding to the second ground 212.

In addition, the shorting arm 431 and feeding arm 432 are disposed in a region (A) where the first and the second ground 211 and 212 are non-overlapped, and the lower metal portion 205 is provided in the non-overlapped region (A). When the case is formed of a metallic material having a conductivity in the non-overlapped region (A), the antenna portion 430 has a structure closed by the ground 210, thereby causing an effect on the electrical characteristics. Accordingly, the lower non-metallic portion 205 may be formed of a dielectric substance having no conductivity, such as plastic or the like.

Figure 7:
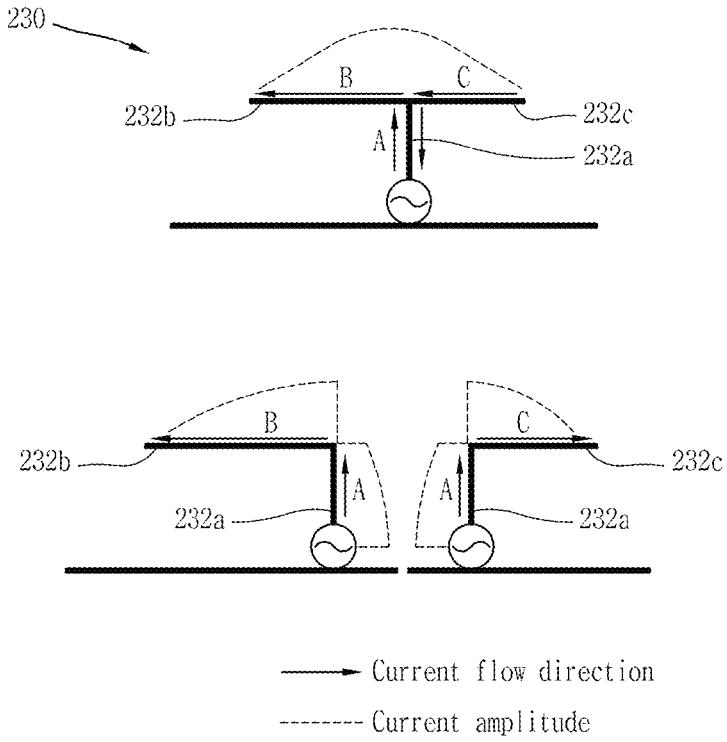
FIG. 7 is a conceptual view illustrating a principle in which the antenna portion based on a feeding arm according to FIG. 2 is operated in a multi-band environment.

Next, FIG. 7 is a conceptual view illustrating a principle in which the antenna portion 230 based on the feeding arm 232 according to FIG. 2 is operated in a multi-band environment. In more detail, the antenna portion 230 may be operated in multiple modes, such as a first mode operated in the first frequency band having a center frequency of 920 MHz, a second mode operated in the second frequency band having a center frequency of 1800 MHz, and a third mode operated in the third frequency band having a center frequency of 2030 MHz.

More specifically, the first mode is operated at a bandwidth of 880-900 MHz for GSM 900 services, the second mode at a bandwidth of 1.71-1.88 GHz for DCS 1800 services, and the third mode at a bandwidth of 1.92-2.17 GHz for WCDMA services. On the other hand, the first mode may be operated at an extended bandwidth of 700-960 MHz for LTE/GSM 850 services in addition to the GSM 900 services, and the second mode at an extended bandwidth of 1.71-1.99 GHz for PCS 1900 services in addition to the DCS 1800 services.

Further, the shorting arm 232 includes the vertical feeding arm 232*a*, the first horizontal feeding arm 232*b* extended from the vertical feeding arm 232*a* to one side, and the second horizontal feeding arm 232*c* extended to the other side thereof. When the length of the vertical feeding arm 232*a*, the horizontal feeding arm 232*b* and the intersecting feeding arm 232*c* is A, B, and C, respectively, the feeding arm 232 has a physical resonant length of A+B and an electrical resonant length of λ/4, operating as a monopole requiring the ground 210 in the first mode.

On the other hand, the feeding arm 232 has a physical resonant length of A+B+C and an electrical resonant length of λ/2, operating as a dipole having a weak dependence on the ground 210 in the second mode. In addition, the feeding arm 232 has a physical resonant length of A+C and an electrical resonant length of λ/4, operating as a monopole requiring the ground 210 in the third mode.

Figure 8:
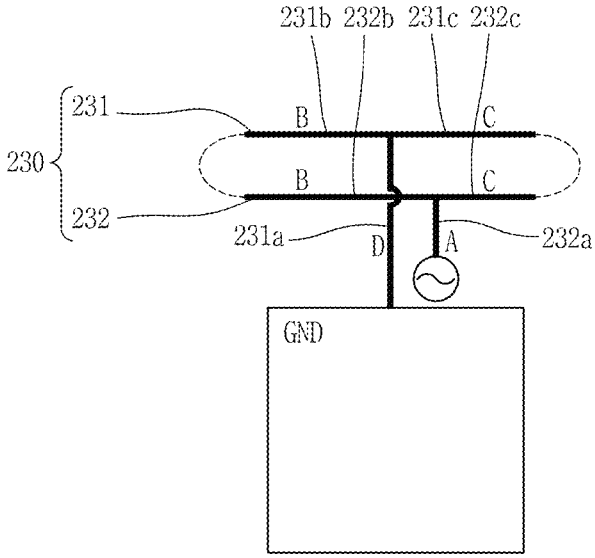
FIG. 8 is a conceptual view illustrating a principle in which the antenna portion according to FIG. 2 is operated in a multi-band environment.

Next, FIG. 8 is a conceptual view illustrating a principle in which the antenna portion 230 according to FIG. 2 is operated in a multi-band environment. In FIG. 8, the shorting arm 231 includes the vertical shorting arm 231*a*, horizontal shorting arm 231*b*, and intersecting feeding arm 231*c*, and the feeding arm 232 includes the vertical feeding arm 232*a*, horizontal feeding arm 232*b*, and intersecting feeding arm 232*c*.

Further, the antenna portion 230 has a structure arrayed with the shorting arm 231 and feeding arm 232, operating as a folded monopole or folded dipole contrary to that of the feeding arm 232. When the shorting arm 231 and feeding arm 232 are arrayed and compared with that of the feeding arm 232, the antenna portion 230 has a characteristic of increased bandwidth, compared to that of a signal element in the aspect of an array characteristic.

If the first horizontal shorting arm 231*b* and first horizontal feeding arm 232*b* have a same length of B, and the second horizontal shorting arm 231*c* and second horizontal feeding arm 232*c* have a same length of C, and the vertical shorting arm 231*a* and vertical feeding arm 232*a* have a length of A and D, respectively, then the operating principle of the antenna portion 230 will be described as follows.

Figure 9A:
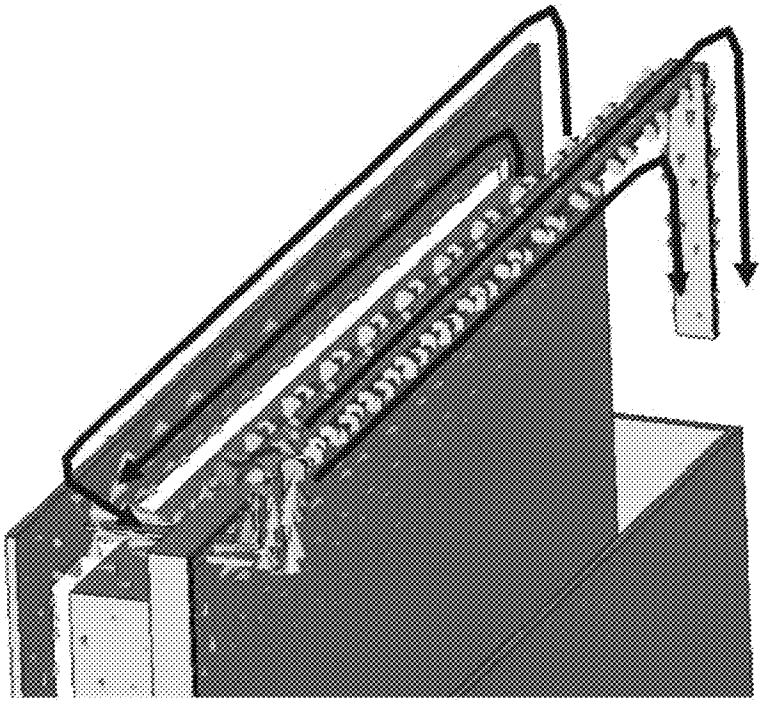
FIG. 9A is a current distribution diagram illustrating the current distribution of the antenna portion according to FIG. 2 in a first mode.

Next, FIG. 9A is a current distribution diagram illustrating the current distribution of the antenna portion according to FIG. 2 in a first mode. The antenna portion has a physical resonant length of A+2B+D and an electrical resonant length of λ/2, operating as a folded monopole requiring the ground in the first mode. As a result, currents having the same direction flow through the shorting arm and feeding arm which are adjoining two conductors, and the susceptance which is the imaginary part of the admittance may be cancelled out each other, thereby having a broader bandwidth and higher efficiency than that of the feeding arm provided with one conductor.

Figure 9B:
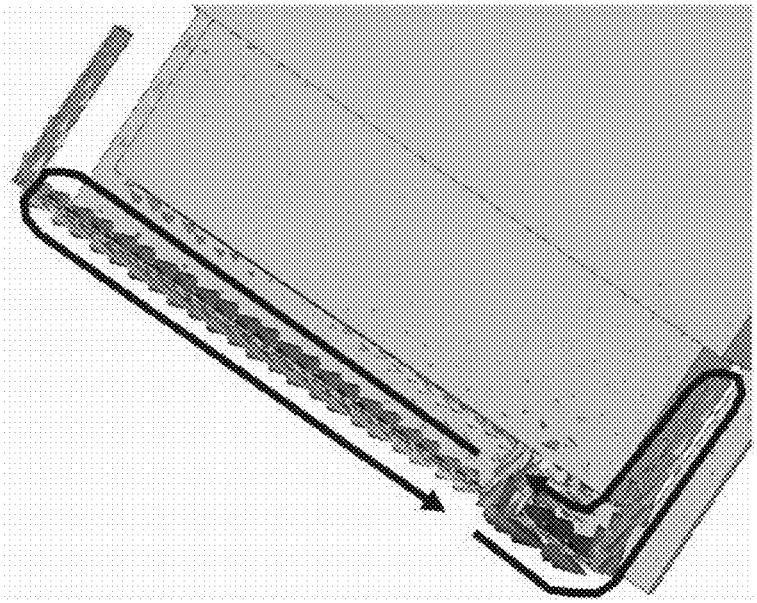
FIG. 9B is a current distribution diagram illustrating the current distribution of the antenna portion according to FIG. 2 in a second mode.

FIG. 9B is a current distribution diagram illustrating the current distribution of the antenna portion according to FIG. 2 in a second mode. The antenna portion has a physical resonant length of A+2B+2C+D and an electrical resonant length of λ, operating as a folded dipole having a low dependency on the ground in the second mode. Here, an open loop by the first horizontal shorting arm and first horizontal feeding arm having a relatively long length of arm, and an open loop by the second horizontal shorting arm and first horizontal feeding arm having a relatively short length of arm may be added, and thus the folded dipole may be operated similarly to a loop antenna.

Figure 9C:
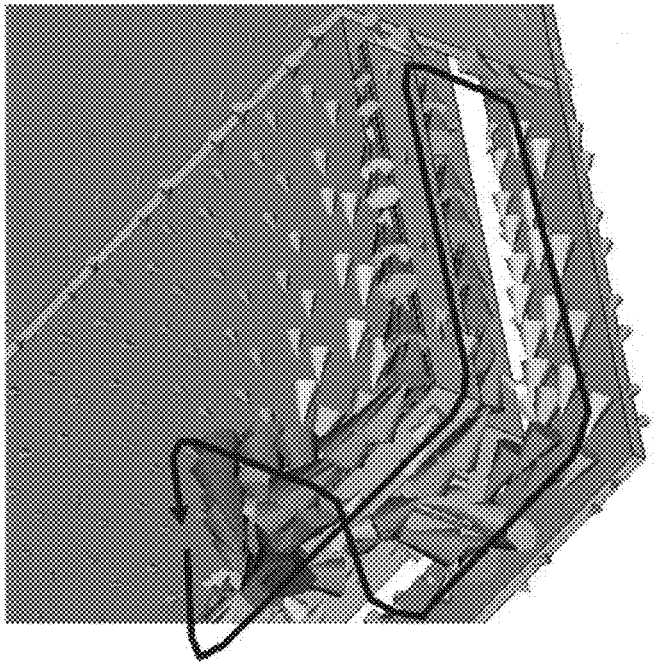
FIG. 9C is a current distribution diagram illustrating the current distribution of the antenna portion according to FIG. 2 in a third mode.

FIG. 9C is a current distribution diagram illustrating the current distribution of the antenna portion according to FIG. 2 in a third mode. The antenna portion has a physical resonant length of A+2C+D and an electrical resonant length of λ/2, operating as a folded monopole requiring the ground in the third mode. Here, a current loop may be added between an open loop by the second horizontal shorting arm and first horizontal feeding arm having a relatively short length of arm and a metal frame, and thus the folded monopole may be operated similarly to a loop antenna.

Figure 10:
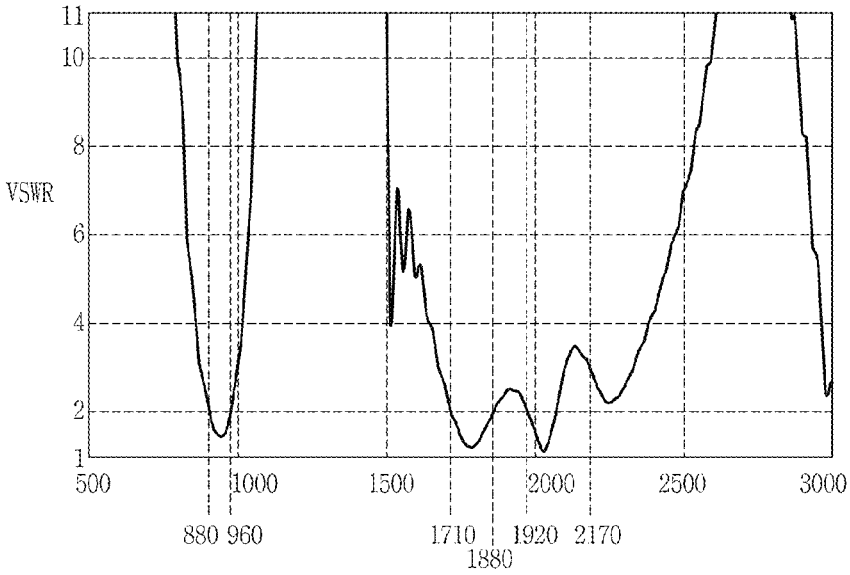
FIG. 10 is a resultant view illustrating a voltage standing wave ratio (VSWR) according to a frequency of the antenna portion according to an embodiment of the present invention.

Next, FIG. 10 is a resultant view illustrating a voltage standing wave ratio (VSWR) according to a frequency of the antenna portion according to an embodiment of the present invention. As shown, the VSWR has a value less than 2 at a bandwidth of 880-960 MHz in the first mode, and at a bandwidth of 1.71-1.88 GHz in the second mode, and has a value less than 4 at a bandwidth of 1.92-2.17 GHz in the third mode.

However, the first mode may be operated at an extended bandwidth of 700-960 MHz to additionally provide LTE or GSM 850 services. More specifically, as illustrated in FIG. 3, the electrical length of a feeding arm may be extended by a coupling aim coupled with an electrical signal of the feeding arm in addition to the length of the feeding arm. Through this, another resonant mode can be generated at a frequency band lower than the first frequency band of the first mode, and the coupling arm can allow the antenna portion to be operated at the extended band of 700-960 MHz.

According to an embodiment of the present invention having the foregoing configuration, a shorting arm and a feeding arm are electrically connected to a metal frame and a power feeding portion, respectively, at an offset position, to provide an antenna device being operated in multiple modes as a folded monopole or folded dipole in a multi-band environment. Accordingly, an integrated communication service requiring a convergence between individual communication services may be implemented by an antenna device operated in multiple modes.

Furthermore, according to an embodiment of the present invention, the length of a shorting arm and a feeding arm and each offset position thereof may be controlled to regulate a resonance frequency at each frequency band. In addition, according to an embodiment of the present invention, broadband characteristics can be provided in a specific mode by a coupling arm disposed to be separated from the feeding arm and coupled with an electrical signal of the feeding arm.

The configurations and methods according to the above-described embodiments will not be applicable in a limited way to the foregoing mobile communication terminal, and all or part of each embodiment may be selectively combined and configured to make various modifications thereto.

What is claimed is:

1. A mobile communication terminal, comprising:

a wireless communication unit configured to communicate with at least one other terminal;

a body including a metal frame having a specified length and a width;

a power feeding portion formed on an internal circuit board in the terminal and configured to supply RF signals; and an antenna portion disposed inside the terminal, wherein the antenna portion includes:

a shorting arm overlapping and being separated from the metal frame, and electrically connected to the metal frame at a first location offset from a middle of an edge of the metal frame; and a feeding arm disposed in parallel to the shorting arm, and electrically connected to the power feeding portion at a second location offset from the middle.

2. The mobile communication terminal of claim 1, further comprising:

a display unit configured to display information, wherein the metal frame is a metal rim surrounding and supporting the display unit.

3. The mobile communication terminal of claim 1, further comprising:

a first ground formed on the body, wherein the metal frame is physically separated from the first ground.

4. The mobile communication terminal of claim 3, wherein the shorting arm and the feeding arm are disposed in a first region where the metal frame and the first ground do not overlap, and a lower metal portion having a conductivity electrically floated from the first ground is provided in the first region.

5. The mobile communication terminal of claim 1, further comprising:

a first ground disposed to be overlapped with part of the metal frame at a position separated from the metal frame, and electrically connected to an edge perpendicular to the other edge of the metal frame at both lateral surfaces thereof; and a second ground corresponding to the metal frame.

6. The mobile communication terminal of claim 5, wherein the shorting arm and feeding arm are disposed in a region where the first and the second ground do not overlap.

7. The mobile communication terminal of claim 1, wherein the shorting arm comprises:

a vertical shorting arm formed between the first location and a third location which is a location vertically separated from the first location;

a first horizontal shorting arm extended from the third location to one side in a linear form; and a second horizontal shorting arm extended from the third location to the other side in a linear form.

8. The mobile communication terminal of claim 7, wherein the shorting arm further includes an intersecting shorting arm bent and extended at both ends of the first and the second horizontal shorting arms.

9. The mobile communication terminal of claim 1, wherein the feeding arm comprises:

a vertical shorting aim formed between the second location and a third location which is a location vertically separated from the second location;

a first horizontal shorting arm extended from the third location to one side in a linear form; and a second horizontal shorting arm extended from the third location to the other side in a linear form.

10. The mobile communication terminal of claim 9, wherein the feeding arm further includes an intersecting shorting arm bent and extended at both ends of the first and the second horizontal feeding arms.

11. The mobile communication terminal of claim 1, further comprising:

a coupling arm disposed to be spaced apart in parallel to the feeding arm, and coupled with an electrical signal of the feeding arm.

12. The mobile communication terminal of claim 1, wherein the shorting arm is electrically connected to the metal frame through a first connector, and the feeding arm is electrically connected to the power feeding portion through a second connector.

13. The mobile communication terminal of claim 12, wherein the first connector comprises:

a first connecting member allowing the shorting arm to be connected to a ground formed on the circuit board; and a second connecting member allowing the ground formed on the circuit board to be connected to a ground formed on the terminal body.

14. The mobile communication terminal of claim 1, wherein the shorting arm and the feeding arm have a meander-shaped pattern to increase an electrical length thereof.

15. The mobile communication terminal of claim 1, wherein the shorting arm and the feeding arm are printed on an upper surface of a dielectric substrate and supported by a dielectric substance of the dielectric substrate.

16. The mobile communication terminal of claim 1, wherein the shorting arm and the feeding arm are separated from each other in a vertical direction and layered thereon.

17. The mobile communication terminal of claim 16, wherein the shorting arm and feeding arm are printed on an upper surface of a plurality of dielectric substrates, respectively, the dielectric circuit substrate being layered thereon in a vertical direction, and separated from each other by a dielectric substance of the dielectric substrate to be supported.

18. The mobile communication terminal of claim 1, wherein the shorting am and the feeding arm are disposed to be separated from each other on the same plane.

19. The mobile communication terminal of claim 18, wherein the shorting arm and the feeding arm are printed on an upper surface of the same dielectric circuit substrate such that the shorting arm and feeding arm are supported by the dielectric substance.

20. The mobile communication terminal of claim 1, wherein the shorting arm is formed on an outer center of a coaxial cable, and the feeding arm is formed on an inner center of the coaxial cable such that the outer and the inner center are electrically connected to the metal frame and power feeding portion, respectively.

* * * * *